US011598061B2

(12) United States Patent
Rasor et al.

(10) Patent No.: US 11,598,061 B2
(45) Date of Patent: Mar. 7, 2023

(54) ICE-CLEARING SHOVEL

(71) Applicants: Joel Reed Rasor, Avon, IN (US); Logan Thomas Throesch, Anderson, IN (US); Noah Payton Hendershot, Indianapolis, IN (US); Bradley James Marcum, Indianapolis, IN (US); Bo Sun, Indianapolis, IN (US); Noah Ali Warfield, Indianapolis, IN (US)

(72) Inventors: Joel Reed Rasor, Avon, IN (US); Logan Thomas Throesch, Anderson, IN (US); Noah Payton Hendershot, Indianapolis, IN (US); Bradley James Marcum, Indianapolis, IN (US); Bo Sun, Indianapolis, IN (US); Noah Ali Warfield, Indianapolis, IN (US)

( * ) Notice: Subject to any disclaimer, the term of this patent is extended or adjusted under 35 U.S.C. 154(b) by 457 days.

(21) Appl. No.: 16/856,962

(22) Filed: Apr. 23, 2020

(65) Prior Publication Data

US 2021/0332544 A1 Oct. 28, 2021

(51) Int. Cl.

| | |
|---|---|
| ***E01H 5/12*** | (2006.01) |
| ***H05B 1/02*** | (2006.01) |
| ***E01H 5/10*** | (2006.01) |
| ***B25F 5/00*** | (2006.01) |
| ***E01H 5/02*** | (2006.01) |
| ***H05B 3/18*** | (2006.01) |

(52) U.S. Cl.

CPC ..... *E01H 5/12* (2013.01); *B25F 5/006* (2013.01); *E01H 5/02* (2013.01); *E01H 5/10* (2013.01); *H05B 1/0252* (2013.01); *H05B 3/18* (2013.01)

(58) Field of Classification Search

CPC .... E01H 5/12; E01H 5/10; E01H 5/02; A01B 1/02; B25F 5/006; H05B 1/0252; H05B 3/18

See application file for complete search history.

(56) References Cited

U.S. PATENT DOCUMENTS

| | | | | |
|---|---|---|---|---|
| 2,699,614 | A | 1/1955 | Welch | |
| 3,741,311 | A * | 6/1973 | Fleurant | A01G 20/30 37/223 |
| 4,034,489 | A * | 7/1977 | Hughes, Jr. | E01H 5/10 219/201 |
| 6,003,916 | A * | 12/1999 | Chalmers | E01H 5/10 294/59 |
| D756,726 | S * | 5/2016 | Packer | D8/10 |
| 10,000,901 | B1 * | 6/2018 | Gallo | E01H 5/02 |
| 10,542,653 | B1 * | 1/2020 | Liversedge | H05B 3/48 |
| 2002/0088148 | A1 | 7/2002 | Kagen | |
| 2003/0094823 | A1 * | 5/2003 | Bradford | A01B 1/02 294/51 |

(Continued)

FOREIGN PATENT DOCUMENTS

| | | | | |
|---|---|---|---|---|
| CA | 2984323 | A1 * | 4/2019 | E01H 5/02 |
| EP | 3381251 | A1 * | 10/2018 | A01B 1/02 |

*Primary Examiner* — Christopher R Harmon

(57) ABSTRACT

A snow shovel that has a shaft, a handle, and a scoop to allow the user to remove unwanted snow and ice from a surface. This shovel includes a heated bottom edge with a vibrating motor to melt and dislodge ice or snow from a surface. The shovel also includes a vibration-reducing mechanism to dampen the vibrations that a user might feel during the use of this shovel, along with sensors that detect when the heated edge and motor should be turned on or off.

19 Claims, 3 Drawing Sheets

(56) References Cited

U.S. PATENT DOCUMENTS

| | | | | |
|---|---|---|---|---|
| 2011/0139763 | A1* | 6/2011 | Glassman | E01H 5/02 7/158 |
| 2019/0127935 | A1* | 5/2019 | Campbell | E01H 5/02 |
| 2022/0268621 | A1* | 8/2022 | Johnson | B25G 1/04 |

* cited by examiner

ICE-CLEARING SHOVEL

TECHNICAL FIELD

The present disclosure generally relates to snow shovels, and in particular, to a heated ice-clearing snow shovel.

BACKGROUND

This section introduces aspects that may help facilitate a better understanding of the disclosure. Accordingly, these statements are to be read in this light and are not to be understood as admissions about what is or is not prior art.

Snow shovel devices are used frequently to clear snow from driveways, walkways, and other surfaces. However, many standard snow shovels are inconsistent and inefficient in their ability to clear a patch of ice from a surface. Thus, some snow shovels have incorporated the use of heat to clear ice, typically through electrical means. However, these designs employ inefficient techniques when applied to remove ice from a surface.

Looking at devices similar to that of Jeff Glassman in US patent application 20110139763, a combination of a snow shovel with an ice chopper that are separated into two different scoops and electrically heated via a removable and rechargeable battery pack is seen. Although the second scoop for a vibrating ice chopper poses an interesting solution, the vibrations felt by a user and the use of two different scoops makes this device difficult for a user to properly control. Furthermore, a conventional battery pack is not able to store enough power for extended use. This poses a problem to users with longer driveways or other large surfaces.

Other, more traditional heated snow shovels, such as that shown by John F. Hughes, Jr. in U.S. Pat. No. 4,034,489, uses an electrical circuit to heat the entire scoop and are powered by an external source via a power cord. This is inefficient because there are parts of the shovel scoop that are being heated which will never come into contact with the surface on which the ice resides, and devices such as these are constantly draining power from their source when it may not be necessary. Furthermore, storing the power cord within the device increases its weight and makes the device burdensome for a user.

Therefore, there is an unmet need for a novel approach to solve the aforementioned problems of a snow shovel that clears ice from a surface.

SUMMARY

A snow shovel with a handle for the person to grab on to. A scoop for removing the unwanted ice or snow from a surface. The handle and the scoop are connected with a shaft. Looking further into the scoop itself there will be a heating element that is inside the bottom edge of the scoop. This will allow for the bottom edge of the scoop to be heated and allow it to more easily break the ice or snow that has gathered on the surface. Also attached to the scoop is a motor device that will vibrate the scoop to help out in dislodging and clearing ice and snow from the surface. There will be a vibration-reducing mechanism that is located within the shaft. This will help to reduce the amount of vibration that the user feels while using the device. There will be sensors located within the device to detect various factors, such as position or acceleration, and determine when the heating element and motor should be turned on or off.

DETAILED DESCRIPTION

Figure 1:
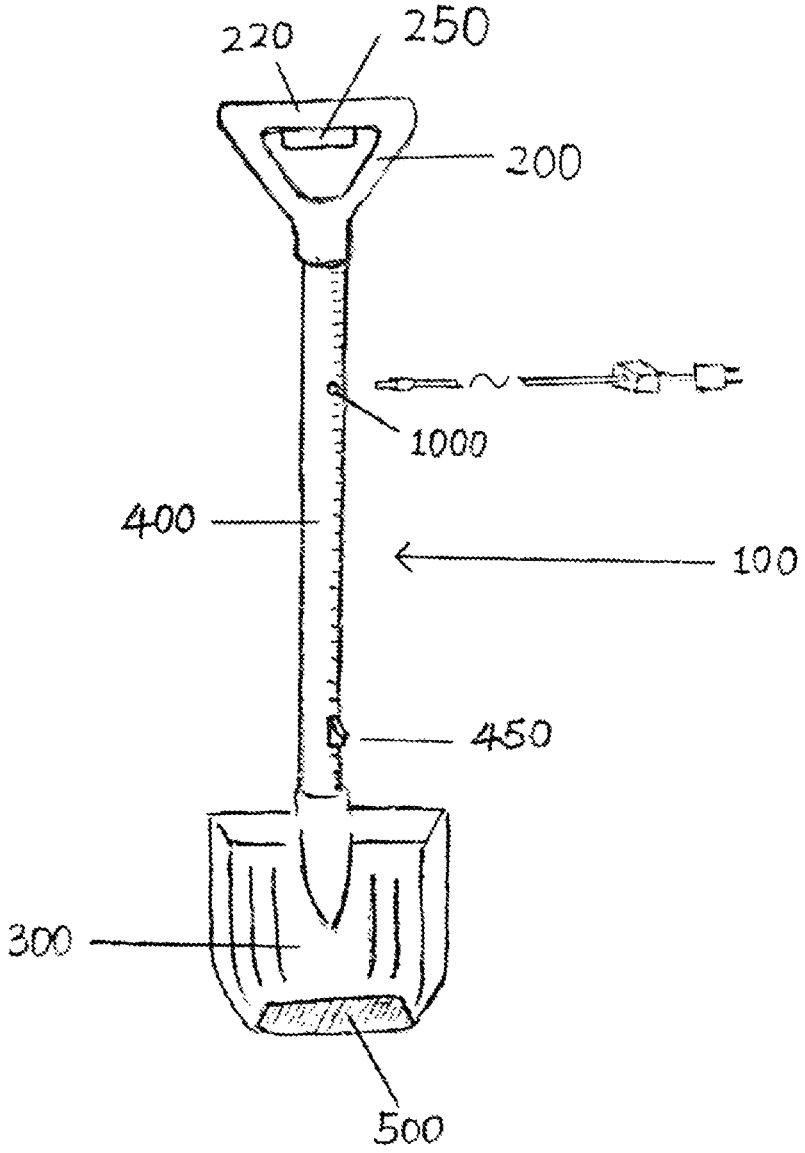
FIG. 1 is a front view of a snow shovel device, including a handle, hand grip, button on a side of the handle, power inlet, shaft, scoop, switch, and bottom edge of scoop.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

In the present disclosure, the term "about" can allow for a degree of variability in a value or range, for example, within 10%, within 5%, or within 1% of a stated value or of a stated limit of a range.

In the present disclosure, the term "substantially" can allow for a degree of variability in a value or range, for example, within 90%, within 95%, or within 99% of a stated value or of a stated limit of a range.

While this disclosure is susceptible of embodiment in many different forms, there is shown in the drawings and described herein in detail a specific embodiment(s) with the understanding that the present disclosure is to be considered as a exemplification and is not intended to be limited to the embodiment(s) illustrated.

It would be understood that like or analogous elements and/or components, referred to herein, may be identified throughout the drawings by like reference numerals. In addition, it will be understood that the drawings are merely schematic representations of the invention, and some of the components may have been distorted from actual scale for purposes of pictorial clarity.

A novel approach removing snow and ice using a snow shovel that clears ice from a surface is disclosed herein. FIG. 1 is a front view of snow shovel device 100 with means to remove snow and ice from a surface. Referring to FIG. 1, said device is made up of a handle 200, having a triangular shape with one of the three points having an opening configured to receive shaft 400. Said opening is connected to one end of a shaft 400, which is to be hollow, where the opposing end of a shaft 400 is connected to a scoop 300. Configured to a top edge of the handle 200 is a hand grip 220. In the present embodiment, a button 250 is configured to a bottom side of hand grip 220, which is about the same length as the hand grip 220. However, one having ordinary skill in the art will readily recognize that button 250 can include many lengths and shapes, such as a circular shape rather than a rectangular shape, and can be placed on any side of handle 200. Furthermore, the skilled artisan will recognize that the handle 200 can take on many shapes other than a triangular shape.

In the present embodiment, the shaft 400 has a circular shape, and spans the distance between the handle 200 and the scoop 300. One of ordinary skill in the art will recognize that the shaft 400 can take on many different shapes, such as a rectangular shape. In the present embodiment, towards the end of the shaft 400 proximate to the scoop 300, is where the switch 450 is located. However, one of ordinary skill in the art will recognize that switch 450 can be placed in several other locations, such as the end of shaft 400 proximate to handle 200. The scoop 300 has an opening on the top edge that is configured to connect to the shaft 400. There is a bottom edge 500 of the scoop 300 which can be made of metal. One of ordinary skill in the art will recognize that the bottom edge 500 can be made of other materials, such as plastic.

Figure 2:
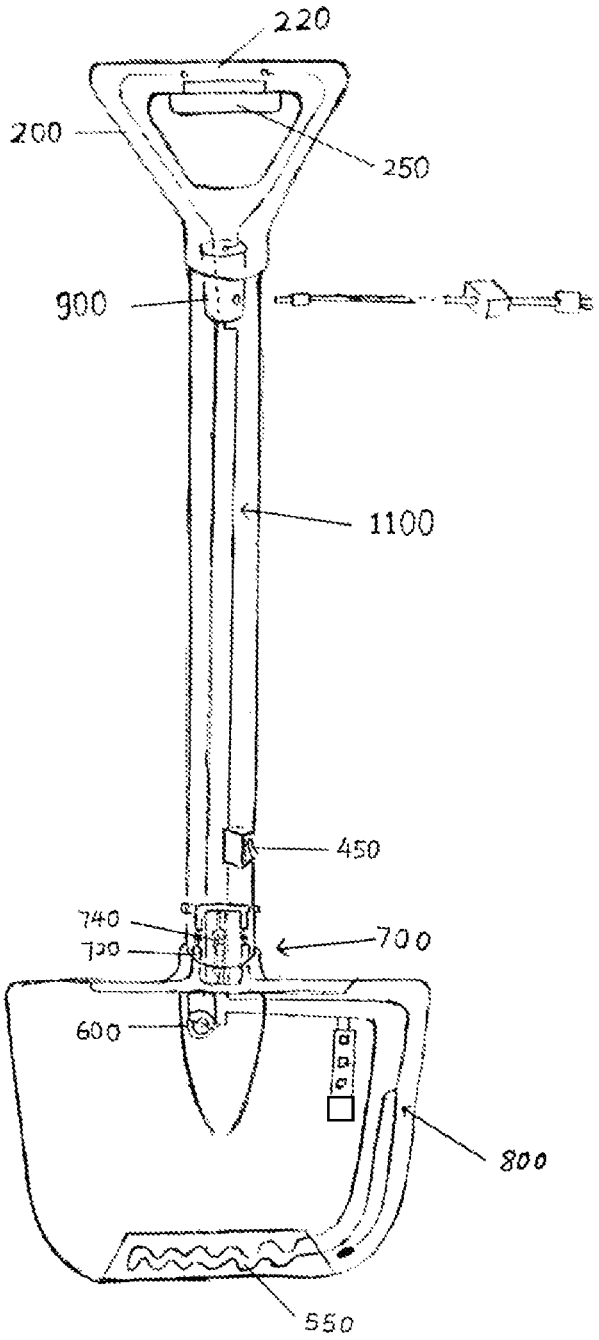
FIG. 2 is an internal view of the shovel device of FIG. 1 showing the following components: rechargeable battery, circuit, shock absorber, suspension system, switch, motor, plurality of sensors, and heating element.

Referring to FIGS. 1 and 2, an on/off switch 450 and a power inlet 1000 lies on a shaft 400. When placed into the on position, switch 450 will complete electrical circuit via cable 1100 and supply power to heating element 550 and motor 600 from a battery 900.

Referring to FIGS. 1 and 2, a power inlet 1000 is on the shaft 400 and is in electrical communication with the rechargeable battery 900. Power inlet 1000 is configured to receive an electrical cord plug. In the present embodiment, the power inlet 1000 is shown to have a configuration that receives a one-prong plug, but one of ordinary skill in the art will readily recognize that the power inlet can take other configurations, such as a configuration that would receive a standard three-prong plug. The end of the electrical cord distal to the shaft 400 may be inserted into a 120-volt outlet, a generator, or other external power source. This will be done in order to place the device 100 into a charging state. While in said charging state, a rechargeable battery 900 will be gaining power.

Referring to FIG. 1, a button 250 is integrated into handle 200. The button 250, when held into the pressed position, turns on the heating element 550 and a motor 600, after the heating element 550 and the motor 600 have been supplied power by placing switch 450 into the on position and completing circuit 1100.

In one embodiment of the present invention, a scoop 300, which is connected to one end of the shaft 400, harnesses a bottom edge 500 of the scoop 300, which houses a heating element 550. The heating element 550 is configured to heat up the bottom edge 500 of the scoop 300, in order to melt and remove ice from the surface.

A rechargeable battery 900 is encompassed within shaft 400, as illustrated in FIG. 2. Rechargeable battery 900 is connected to the switch 450 by use of circuit 1100. When button 250 is held in the pressed position, the motor 600 and heating element 550 are supplied power via rechargeable battery 900 and circuit 1100. In the present embodiment, heating element 550 comprises insulated heating wire.

FIG. 2 shows a motor 600 configured to vibrate the scoop 300 to assist in dislodging and clearing ice and snow from the surface. A vibration-reducing mechanism 700, which comprises a suspension system 720 with at least one shock absorber 740, is placed within the shaft 400 proximate to the scoop 300, in order to reduce the vibrations felt by the user.

In one embodiment of the present invention, a plurality of sensors 800, which are in electrical communication with the heating element 550 and the motor 600 via circuit 1100, are placed within scoop 300, with each sensor potentially corresponding to a specific type of action. For example, heat sensor 880 is configured to detect the amount of heat dissipating from heating element 550. As such, heat sensor 880 can be used to determine if heating element 550 is about to overheat and turn the heating element 550 on or off accordingly. Another example is that load sensor 860 is configured to detect the amount of snow and ice that scoop 300 is carrying. As such, load sensor 860 can be used to turn off vibrating motor 600 when scoop 300 is carrying a full load. These examples are provided to improve understanding of the present invention, and are not intended to limit the scope of the invention in any way. One of ordinary skill in the art will recognize that the plurality of sensors 800 can take on many applications that are not discussed herewith.

In one embodiment of the present invention, a contact sensor 820 is provided and configured to detect when the scoop 300 is in contact with the surface. The contact sensor 820 is placed in a position above the bottom edge 500 of scoop 300. One of ordinary skill in the art will recognize that contact sensor 820 can be placed in several other locations, such as within the bottom edge 500 of scoop 300. Therefore, the placement location of contact sensor 820 in the shown embodiment should not be construed as limiting in any way.

In one embodiment of the present invention, an acceleration sensor 840 is provided and configured to detect when the scoop 300 encounters a patch of ice on the surface. The acceleration sensor is placed in a position above the bottom edge 500 of scoop 300. One of ordinary skill in the art will recognize that acceleration sensor 840 can be placed in several other locations, such as within the bottom edge 500 of scoop 300. Therefore, the placement location of acceleration sensor 840 in the shown embodiment should not be construed as limiting in any way.

In one embodiment of the present invention, a load sensor 860 is provided and configured to detect the amount of snow and ice contained in the scoop 300. The load sensor is placed in a position above the bottom edge 500 of scoop 300. One of ordinary skill in the art will recognize that load sensor 860 can be placed in several other locations, such as within the bottom edge 500 of scoop 300. Therefore, the placement location of load sensor 860 in the shown embodiment should not be construed as limiting in any way.

In one embodiment of the present invention, a heat sensor 880 is provided and configured to detect the heat output of the heating element 550 and prevent said heating element 550 from overheating. The heat sensor is placed in a position above the bottom edge 500 of scoop 300. One of ordinary skill in the art will recognize that the heat sensor 880 can be placed in several other locations, such as within the bottom edge 500 of scoop 300. Therefore, the placement location of heat sensor 880 in the shown embodiment should not be construed as limiting in any way.

Figure 3:
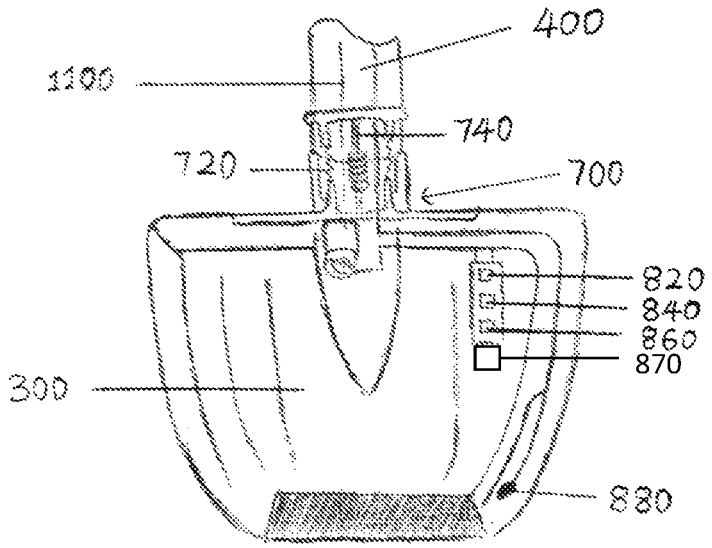
FIG. 3 is a partially internal view of the scoop shown in FIGS. 1 and 2.

The snow shovel device 100 also includes 1 a controller 870 shown in FIGS. 2 and 3, where the controller is configured to receive signals from the aforementioned sensors and use the sensor signals to determine when to turn the motor 600 and the heating element 550 on or off. For example, if the temperature signal provided by the heat sensor reaches a predetermined threshold, the controller using, e.g., a hysteresis method known to a person having ordinary skill in the art, turns the heating element 550 on or off. In another example, if the acceleration sensor 840 produces a signal associated with a sudden halting of the motion and provides the same to the controller, the controller then turns of the motor, and once the acceleration sensor 840 provides a signal associated with motion of the snow shovel device 100, the motor 600 is immediately turned off.

It will be apparent to one with ordinary skill in the art that the invention may be provided using some or all the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

Those having ordinary skill in the art will recognize that numerous modifications can be made to the specific implementations described above. The implementations should not be limited to the particular limitations described. Other implementations may be possible.

The invention claimed is:

1. A snow shovel device comprising:

a handle;

a scoop adapted to lift and clear snow and ice from a surface, having a bottom edge;

a shaft, wherein the handle is attached to one end of the shaft, and the scoop is attached to an opposing end of the shaft;

a heating element configured to heat the bottom edge of the scoop for melting ice;

a motor configured to vibrate the scoop to assist in dislodging and clearing ice from the surface;

a plurality of sensors configured to provide signals commensurate with temperature data of the scoop and acceleration of the scoop; and a controller adapted to receive the signals from the plurality of sensors and determine when the heating element and the motor should be turned on or off in response to predetermined thresholds for the associated signals.

2. The device according to claim 1, wherein the heating element, the sensors, and the motor are electrically powered via a rechargeable battery located within the shaft.

3. The device according to claim 1, wherein the shaft is cylindrical.

4. The device according to claim 1, wherein the handle comprises a triangular shape, where one of three points of said shape contains an opening configured to receive the cross-sectional shape of the shaft.

5. The device according to claim 4, wherein the handle further comprises a top edge, which opposes the opening configured to receive the cross-sectional shape of the shaft, is configured with a hand grip.

6. The device according to claim 1, wherein the scoop comprises a top edge, where said top edge contains an opening configured to receive the cross-sectional shape of the shaft.

7. The device according to claim 1, wherein the heating element, the sensors, and the motor are connected to an electrical circuit and supplied power by placing an on/off switch into the on position, where the switch is located on the shaft.

8. The device according to claim 1, wherein a button on a side of the handle, when held into a pressed position, is configured to turn on the heating element and the motor, after the heating element and the motor have been supplied power.

9. The device according to claim 8, wherein the button is configured to be positioned at a bottom side of a hand grip.

10. The device according to claim 2, wherein the rechargeable battery is charged by an external power source via an electrical cord engaged with a power inlet on the device, where the power inlet is configured to receive a plug of said electrical cord.

11. The device according to claim 1, wherein the plurality of sensors are in electrical communication with the heating element and the motor, and are configured to automatically turn the heating element and the motor on and off independently of the button on the side of the handle.

12. The device according to claim 1, wherein the plurality of sensors further comprise a contact sensor configured to detect when the scoop is in contact with the surface.

13. The device according to claim 1, wherein the plurality of sensors are further configured to detect when the scoop encounters a patch of ice on the surface.

14. The device according to claim 1, wherein the plurality of sensors further comprise a load sensor configured to detect the amount of snow and ice contained in the scoop.

15. The device according to claim 1, wherein the heating element configured to heat the bottom edge of the scoop is insulated heating wire.

16. The device according to claim 1, wherein the plurality of sensors further comprise a heat sensor configured to detect the heat output of the heating element.

17. The device according to claim 1, further comprising a vibration-reducing mechanism located within the shaft configured to reduce the vibrations felt by a user.

18. The device according to claim 17, wherein the vibration-reducing mechanism comprises a suspension system with at least one shock absorber.

19. The device according to claim 1, wherein the bottom edge of the scoop is made of metal.

* * * * *